US006139350A

United States Patent [19]

Mathesius

[11] Patent Number: 6,139,350

[45] Date of Patent: Oct. 31, 2000

[54] LATCHING SYSTEM FOR A PIN-AND-SOCKET CONNECTOR

[75] Inventor: Christian Mathesius, Aachen, Germany

[73] Assignee: Siemens Aktiengesellschaft, Munich, Germany

[21] Appl. No.: 09/180,496

[22] PCT Filed: Apr. 28, 1997

[86] PCT No.: PCT/DE97/00861

§ 371 Date: Nov. 10, 1998

§ 102(e) Date: Nov. 10, 1998

[87] PCT Pub. No.: WO97/44864

PCT Pub. Date: Nov. 27, 1997

[30] Foreign Application Priority Data

May 20, 1996 [DE] Germany ..... 196 20 182

[51] Int. Cl.[7] ..... H01R 13/627

[52] U.S. Cl. ..... 439/357; 439/607

[58] Field of Search ..... 439/350–357, 439/607, 609, 610

[56] References Cited

U.S. PATENT DOCUMENTS 4,337,989 7/1982 Asick et al. .

4,941,849 7/1990 Fujiura .

5,362,249 11/1994 Carter .

5,637,014 6/1997 Sukegawa et al. ..... 439/607

OTHER PUBLICATIONS

Gefrides et al, "Standard Bus Connects up to 126 Peripherals: Plug and Play with USB", *Siemens Components*, vol. 31, No. 3, 1996, pp. 36–38.

*Primary Examiner*—Khiem Nguyen

*Attorney, Agent, or Firm*—Hill & Simpson

[57] ABSTRACT

A screened plug-in socket connector has an insulation body, which, in the plug-in region, is constructed as a plastic tongue with an essentially rectangular cross-section, and the connector has a shroud surrounding the tongue. The connector has two pairs of latching hooks with the hooks of each pair being alongside each other and being offset inwards, which hooks are constructed in the cover and in the bottom of the shroud and can be latched into recesses of a screening housing of a plugged-in mating connector. The upper side of the plastic tongue has two depressions, into which in each case one of the two upper latching hooks penetrates from above.

1 Claim, 2 Drawing Sheets

LATCHING SYSTEM FOR A PIN-AND-SOCKET CONNECTOR

BACKGROUND OF THE INVENTION

The invention relates to a screened plug-in socket connector having an insulation body which, in the plug-in region, is constructed as a plastic tongue with an essentially rectangular cross-section, and having a shroud which is essentially rectangular in cross-section, in which the insulation body is accommodated in such a way that a relatively narrow first free intermediate region is formed between the upper side of the plastic tongue and the cover of the shroud, and a relatively broad second free intermediate region is formed between the underside of the plastic tongue and the bottom of the shroud. The connector has a plurality of contact tracks, which run in parallel in the plug-in direction and are arranged on the underside of the plastic tongue, and the connector has in each case two latching hooks which lie alongside each other and are offset inwards, are constructed in the cover and in the bottom of the shroud and can be latched into recesses in the cover and in the bottom of a screening housing of a plugged-in mating connector with the cover of the screening housing of a plugged-in mating connector resting on the upper side of the plastic tongue.

Plug connectors of this type have become known and are of interest in particular in conjunction with the standardized USB (Universal Serial Bus) concept which is the aim of a number of computer manufacturers. This new bus system is based on the principle of not connecting peripheral devices to a PC, as previously done by using individual parallel connections having separate and often different plug connector systems but instead of connecting the peripheral devices essentially serially to a common bus line, which is directly connected to a printed circuit board (mother board) of the PC via a standardized socket on the housing of the PC. The plug-in face of the printed circuit board socket or receptacle according to is essentially already defined by a specification and has four strip-shaped contact springs which lie alongside one another in one plane and, when the bus plug is plugged in, cooperate with the four contact rails or tracks which are arranged lying alongside one another in the plug and produce the electrical contact. The contact springs are arranged in the plug-in socket in an insulation body which is essentially constructed as a plastic tongue of rectangular cross-section, and are bent over in their rear region to form downwardly projecting connecting legs which can be plugged into contact holes in the printed circuit board. Plug and mating connector are normally provided with a metallic screening housing. In the cover and bottom region of these shrouds, in each case two latching hooks are provided which engage in recesses on the screening housing of the suitable mating connector and provide the earthing or grounding contact and the holding forces when pulling out the plug.

FIG. 4 illustrates how, in the case of a plug connector pair according to the specification, the upper latching hook 7 is placed in the recess or aperture 11 of the screening housing 13 of the mating connector 14. In addition to the spring stiffness, the level of the force effect primarily depends on how deeply the latching hook 7 snaps into the recess 11. The greater the coverage penetration, the more severely is the spring stressed when pulling out the mating connector 14. In the case of the known connector, the coverage penetration is limited by the sheet-metal thickness of the mating connector, since the latching hook 7 then rests on the plastic tongue 1 of the plug-in socket.

SUMMARY OF THE INVENTION

The present invention is based on the object of providing a plug-in socket connector of the type mentioned at the beginning in which the pull-out force is increased.

In the case of a plug connector of the type mentioned at the beginning, this object is achieved in that the upper side of the plastic tongue has two depressions into which in each case one of the two upper latching hooks penetrates from above.

DESCRIPTION OF THE PREFERRED EMBODIMENTS

Figure 1:
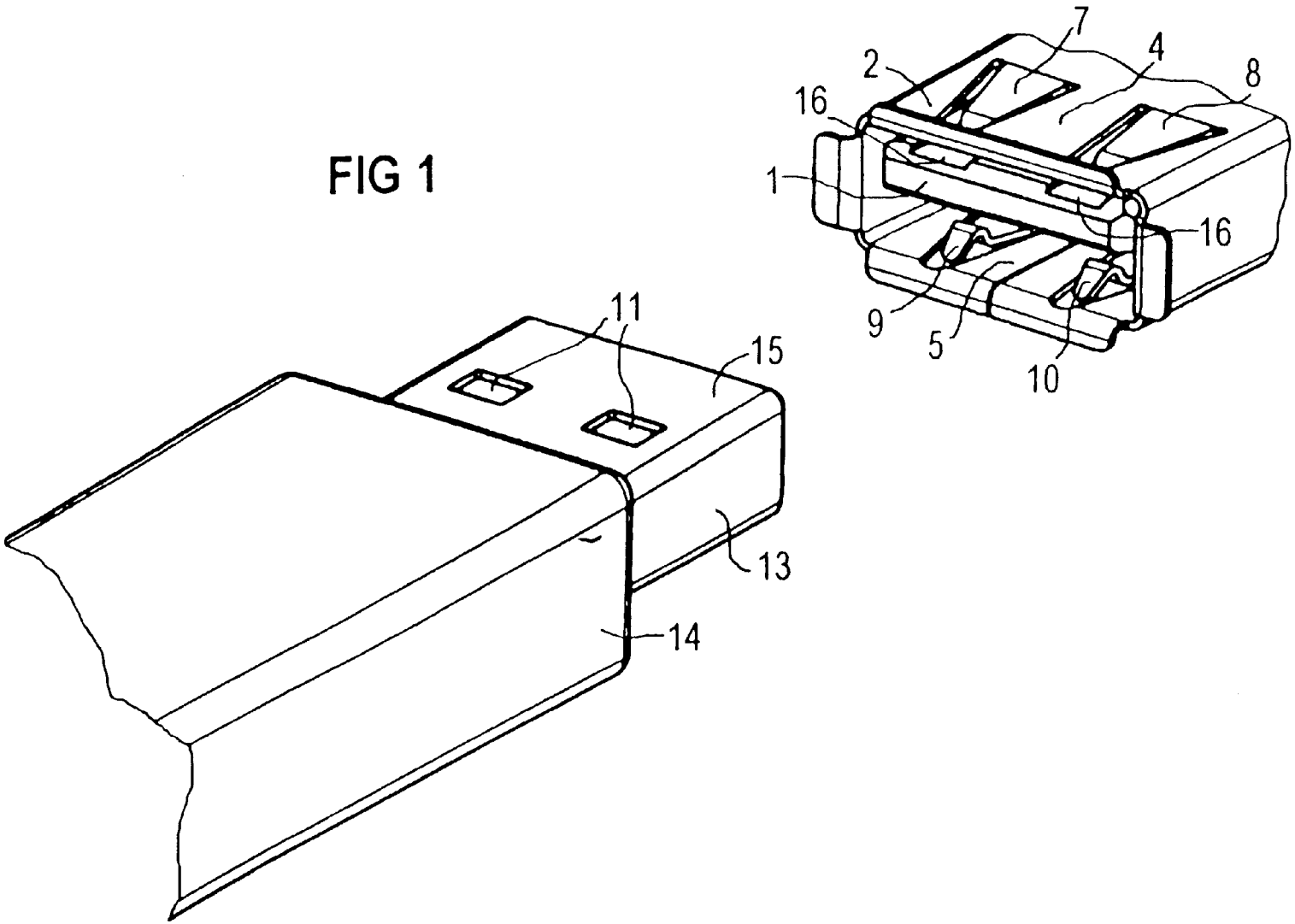
FIG. 1 is a perspective view of a plug-in socket connector according to the invention together with a mating connector which are not yet plugged together.
Figure 2:
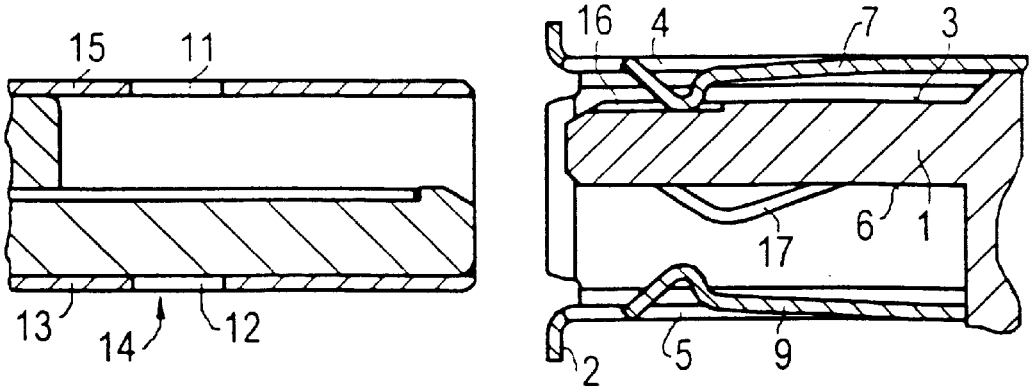
FIG. 2 is a cross-sectional view of the plug connector pair according to FIG. 1; in a sectioned side view.
Figure 3:
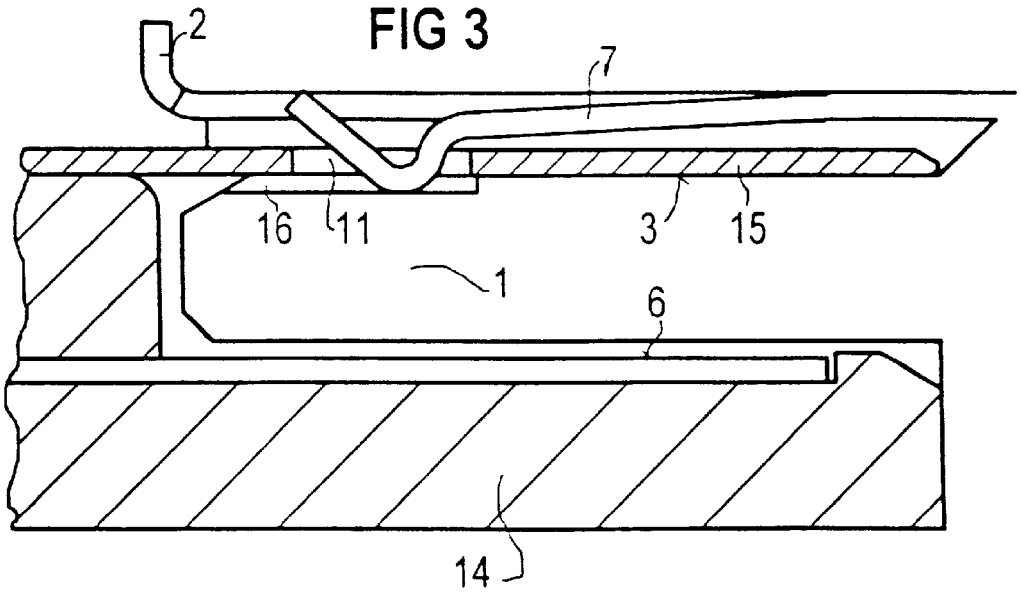
FIG. 3 is a schematic sectional side view of the plug connector pair according to FIGS. 1 and 2, but in the plugged-in state.
Figure 4:
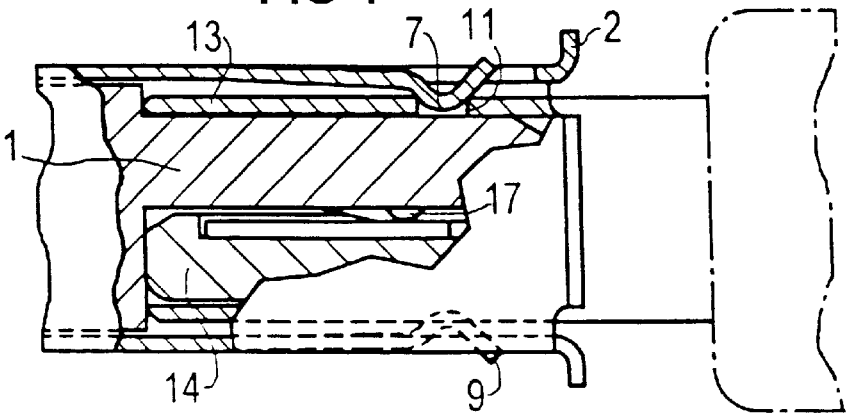
FIG. 4 is a cross-sectional view of a plugged together plug connector pair according to the prior art.

In FIGS. 1 to 3 it is possible to see in each case, on the one hand a cable connector 14 with its screening housing 13 and the recesses or openings 11, 12 and, on the other hand, the plug-in socket 20 with its typical plug-in face. The socket 20 has an integrated plastic tongue 1 surrounded by a shroud 2 having a cover 4 and a bottom 5, which have latching hooks 7, 8 and 9, 10 which are arranged in pairs. In addition, it is possible to see the integrated plastic tongue 1, which forms part of the insulation body of the socket 20. An upper side 3 of the plastic tongue 1 has two depressions 16, into which the upper latching hooks 7, 8 penetrate from above. In particular in the plugged-in connector pair according to FIG. 3, it is possible to see the large degree of coverage or penetration of the latching hooks 7 and 8 into screening housings 13 of the cable connector, by means of which the pull-out force is significantly increased. In the position illustrated, the latching hooks 7 snap behind in a reliable and well-placed manner. Despite depressions 16 on the upper side 3 and recesses for the contact tracks 17 on the underside 6 of the plastic tongue 3, the latter still has adequate stability. It is of course also possible for the depressions 16 according to the invention to be advantageously provided on the underside of the complementary plastic tongue of the mating connector 14.

What is claimed is:

1. In a screened plug-in socket connector comprising an insulation body which, in a plug-in region, is constructed as a plastic tongue with an essentially rectangular cross-section; a shroud, which is essentially rectangular in cross-section, in which the insulation body is accommodated so that a relatively narrow first free intermediate region is formed between an upper side of the plastic tongue and a cover of the shroud, and a relatively broad second free intermediate region is formed between an underside of the plastic tongue and a bottom of the shroud; a plurality of contact tracks, which run in parallel in the plug-in direction, being arranged on the underside of the plastic tongue; two pairs of latching hooks with the hooks of each pair being alongside each other and being offset inwards, one pair of hooks being constructed in the cover and the other pair of hooks being in the bottom of the shroud and said hooks being latched into recesses in a screening cover and in a bottom of a screening housing of a plugged-in mating connector which has the screening cover resting on the upper side of the plastic tongue, the improvement being the upper side of the plastic tongue having two depressions, into which the two upper latching hooks penetrate from above.

* * * * *